United States Patent [19]

Balluff

[11] 3,975,826

[45] Aug. 24, 1976

[54] CATALYTIC CONVERTER FOR EXHAUST GASES

[75] Inventor: Robert N. Balluff, Rives Junction, Mich.

[73] Assignee: Tenneco Inc., Racine, Wis.

[22] Filed: Jan. 2, 1974

[21] Appl. No.: 430,299

Related U.S. Application Data

[62] Division of Ser. No. 207,793, Dec. 4, 1971, Pat. No. 3,798,006.

[52] U.S. Cl. ..... 29/157 R; 23/288 FC; 138/108; 138/112; 138/113; 156/305

[51] Int. Cl.[2] ..... B01J 8/00; F01N 3/15; B21D 53/00; B23P 15/26

[58] Field of Search ..... 23/288 F, 288 FC; 138/108, 112, 113; 156/62.4, 89, 165, 305; 29/DIG. 1, DIG. 3, 157 R, 422, 473.9

[56] References Cited

UNITED STATES PATENTS

| | | | |
|---|---|---|---|
| 1,646,356 | 10/1927 | Johnson | 29/450 X |
| 3,018,841 | 1/1962 | Gerlich | 23/288 FC UX |
| 3,065,595 | 11/1962 | Gary | 23/288 F UX |
| 3,109,259 | 11/1963 | Viall | 29/452 X |
| 3,362,783 | 1/1968 | Leak | 23/288 F X |
| 3,404,965 | 10/1968 | Shiller | 23/288 F |
| 3,410,651 | 11/1968 | Brandenberg et al. | 23/288 F UX |
| 3,441,381 | 4/1969 | Keith et al. | 23/288 F |
| 3,441,382 | 4/1969 | Keith et al. | 23/288 F |
| 3,490,136 | 1/1970 | Stickley | 29/451 X |
| 3,503,716 | 3/1970 | Berger | 23/288 F |
| 3,692,497 | 9/1972 | Keith et al. | 23/288 F |
| 3,785,781 | 1/1974 | Hervert et al. | 23/288 F |
| 3,787,944 | 1/1974 | Mittman | 29/451 X |

*Primary Examiner*—Barry S. Richman
*Attorney, Agent, or Firm*—Harness, Dickey & Pierce

[57] ABSTRACT

A catalytic converter, and method of assembling same, adapted for use in the exhaust systems of internal combustion engines comprises a housing including as a part thereof a tubular shell having a differentially hardened, annular fibrous lining to resiliently support, insulate, and secure a monolithic type catalyst element. The ends of the tubular shell extend beyond the fibrous lining, which in turn extends beyond the upstream and downstream ends of the catalyst element. The ends of the shell and the ends of the fibrous lining are angularly deformed inwardly to protect the corners of the catalyst, to minimize gas impingement on the fibrous material, and to mechanically retain the catalyst in position. The method includes the steps of inserting the monolithic catalyst into the shell with the annular resilient lining in place around the periphery of the catalyst, bending the ends of both the shell and liner over the ends of the catalyst and subsequently attaching inlet and outlet conduits to the ends of the shell.

12 Claims, 3 Drawing Figures

CATALYTIC CONVERTER FOR EXHAUST GASES

PARENT APPLICATION

This application is a division of my copending application Ser. No. 207,793, filed Dec. 14, 1971, now U.S. Pat. No. 3,798,006, issued Mar. 19, 1974, and assigned to the assignee hereof.

RELATED APPLICATION

U.S. application Ser. No. 207,794, entitled "Catalytic Reactor with Monolithic Element," filed on Dec. 14, 1971 and now U.S. Pat. No. 3,771,967, issued Nov. 13, 1973, of Hubert H. Nowak and assigned to the assignee hereof concerns features relating to the fibrous mounting layer and impregnation thereof.

BRIEF SUMMARY OF THE INVENTION

It is the basic purpose of this invention to provide an improved type mounting for a monolithic type or honeycomb catalyst element which is suitable for mass manufacture and for use in exhaust systems of automotive internal combustion engines.

The invention accomplishes this purpose by use of an impregnated fibrous sleeve to mount the monolithic catalyst element on a tube or ring which forms a part of the converter housing. Preferably, prior to assembly of the housing, at least the downstream end of the sleeve and preferably the ring are angularly deformed inwardly to provide a combination seal, retainer, and protector for the catalyst element.

DESCRIPTION OF THE INVENTION

Figure 1:
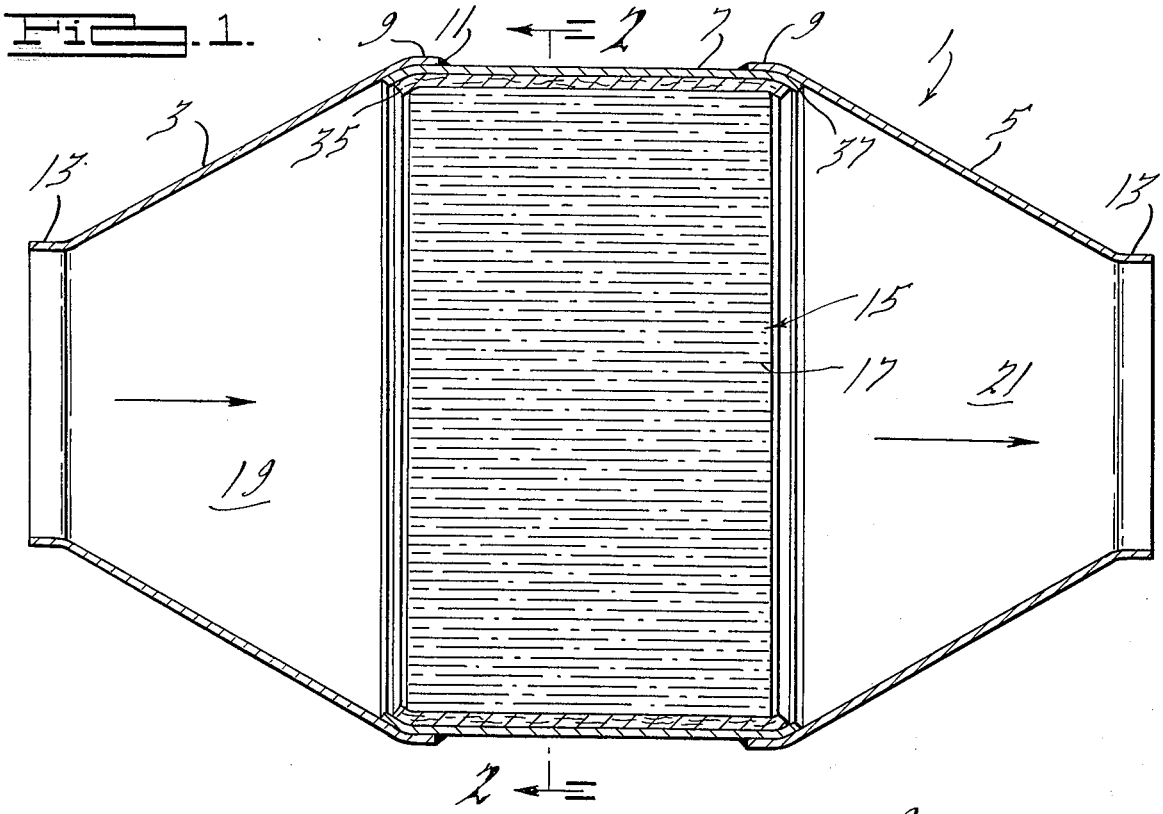
FIG. 1 is a longitudinal cross section through a catalyst converter embodying the invention.
Figure 2:
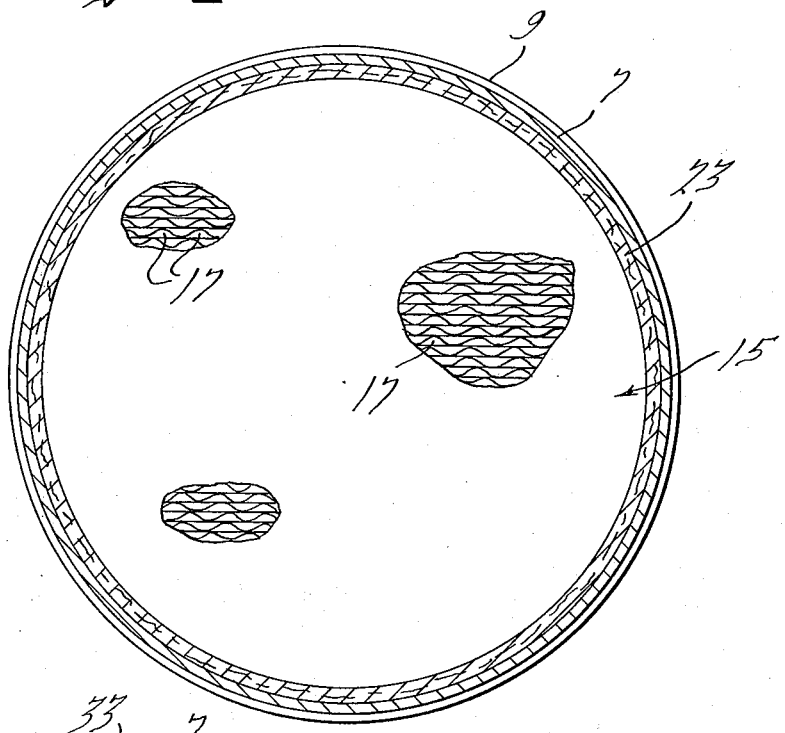
FIG. 2 is a cross section along the line 2—2 of FIG. 1.
Figure 3:
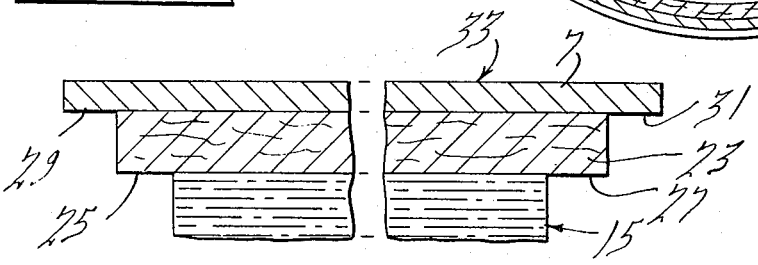
FIG. 3 is an enlarged partial subassembly view (prior to crimping) of the catalyst element, the fibrous sleeve, and the housing ring.

The catalytic converter 1 has a three piece housing comprising an inlet header cone 3, an outlet header cone 5, and an intermediate round tubular ring 7 which fits inside of and is welded to annular end sections 9 on the cones as seen at 11. The inlet and outlet cones have suitable collars 13 at their outer ends whereby they may be secured to conduits in the exhaust system of an internal combustion engine. The converter 1 contains a monolithic type honeycomb catalyst element 15 which has a large number of cellular passages 17 through which gas can flow from the inlet chamber 19 in cone 3 to the outlet chamber 21 in cone 5. The element 15 is constructed of a suitable refractory or ceramic material and appropriate catalytic material is deposited on the walls of the passages 17 whereby the refractory material serves as a support for the catalytic material, a more extensive description of one form of element 15 being found in U.S. Pat. No. 3,441,381. Catalytic elements of this type are very fragile and in the course of manufacture, particularly on a large scale, it is very easy for them to become damaged, particularly at the corners. They are also subject to wearing, abrasion, chipping, and fracture in use due to shock loads, differential expansion rates as compared with the metal of the container, and relative abrasive movement between it and the harder metal part.

In accordance with this invention, there is a resilient wall or interface 23 between the element 15 and the metal ring 7. The wall is preferably formed of ceramic fiber material such as blown alumina silica felted fibers sold under the tradenames "Fiberfrax," "Cera Fiber," or "Kaowool." Other high temperature resistant fibers, such as (but not limited to) asbestos, may also be used to form the layer 23 in certain applications. In a typical assembly where the element is 4 – 5 inches in diameter a felted layer or sleeve of ceramic fibers about ¼ inch thick is wrapped around the element 15. This combination of fiber 23 and element 15 is then inserted into ring or shell 7, the diameter of which is such that the wall 23 is radially compressed to a nominal 3/16 inch thickness. In the presently preferred arrangement, the fiber wrap 23 extends longitudinally beyond the ends of the element 15, as seen at 25 and 27 for, preferably, about ⅛ inch; and the metal shell 7 extends beyond the ends of element 15 for, preferably, about ¼ inch as seen at 29 and 31. The ends 29 and 31 of the ring 7 are curled or deformed inwardly on angles of preferably about 30° and this causes the ends 25 and 27 of the fiber sleeve to curl over the corners of the element so that they can protect them without closing off any flow channels 17 of the element.

After assembly and end crimping of the ring 7, the element 15, and the layer 23, a suitable rigidizer, binder, and adhesive liquid containing a high temperature withstanding material, such as an aqueous colloidal solution of silica containing from 15 to 40% $SiO_2$ by weight or other suitable organic binder is applied to the layer 23. This solution may be applied before assembly to the shell and/or element or may be injected by needle or other suitable means into the layer 23. The amount of solution used is controlled so that it is insufficient to penetrate and coat the walls of channels 17 but large enough to provide the necessary amount of dry silica (or binder) needed to harden the ends of the layer. After injection, the assembly 33 is put through a drying process, for example, placed in an oven at a temperature of about 250° F or higher, so that the water or other liquid in the colloidal solution is removed. In drying, the silica solids migrate with the liquid vehicle to the points where vaporization occurs and are deposited at those points to a substantially greater degree than elsewhere. This means that the silica solids tend to concentrate at the exposed ends 25 and 27 of the sleeve 23 and to a lesser extent at the interfaces of the sleeve and the ring 7 and the element 15. Selective heating, instead of oven drying, can be used, if desired, to control the areas of deposition of silica.

After complete drying, the silica serves to bond the fibers of sleeve 23 together and to the adjacent surfaces of ring 7 and element 15. The hardened silica provides an effective positive seal against gas leakage from the usual broken cell walls around the outside of the honeycomb element 15. Further, the hardened silica rigidizes and seals the ends 25 and 27 of the fiber to form a positive gas barrier making the sleeve gas impervious. It also provides a positive, nonmetallic mechanical lock between the element 15 and the metal ring 7 so that the element is well supported but is not in contact with metal. Despite the effects just mentioned, the bulk of the fiber wrap 23 between the hardened surface layers has very little hardened silica, if any, and is, after drying, practically as resilient as the original fiber layer before hardening. Thus, the layer 23 functions as an absorbent barrier to insulate and protect the element 15 from mechanical shocks. It also functions as a thermal insulation barrier between the metal shell 7 and the element 15. It is apparent that the density and hardness of layer 23 can be controlled by control of the nature and amount of the rigidizer and adhesive liquid.

The ring 7 and sleeve 23 serve as a carrier and protector for the frangible element 15 and minimize the possibility of damage to the element during assembly of the unit 33 with the headers 3 and 5. As indicated, this assembly is completed to form converter 1 by welding, or other suitable fastening, as shown at 11.

In use of the converter 1, exhaust gas enters the inlet header 3 and flows directly through the catalyst treated passages 17 of the honeycomb 15 into the outlet chamber 21 and then out of the converter. The radially extending or angular flange portions 35 and 37 at the inlet and outlet sides of the assembly 33, in addition to the functions mentioned above, serve also to deflect gas away from the sleeve 23 and into the element 15 to minimize impingement upon and erosion of the sleeve.

It will be seen that the described mounting of the element 15 on metal shell 7 has many desirable features. It enables nearly 100 percent of the volume of element 15 to be used since none of the passages 17 are blocked off. It provides effective positive sealing against leakage around the outside of the element, despite the usual rough and broken outer surface of the element, and eliminates the need for a special seal coating on the outside of the element. It eliminates abrasion of the element by eliminating all metal contact with the element. It provides positive mechanical locking as well as adhesive bonding of the element to the shell 7 and converter housing. It provides a resilient interface between the element 15 and the shell 7 which gives a high degree of mechanical shock resistance and which eliminates stringent dimensional tolerances. Since the ceramic fibers are stable up to the usual maximum catalyst operating temperatures (about 2300° F), the converter is operative and safe at all temperatures encountered in normal usage of the element. The simple structure of the converter 1 enables the thickness of the layer 23 to be readily varied in accordance with the degree of thermal and shock insulation desired. The arrangement provides for substantially stress-free relative movement between the element and ring 7 such as occasioned by different rates of thermal expansion and contraction. The thermal insulating properties of layer 23 also minimize the temperature of the metal housing to protect the surrounding environment, provide for faster warm-up and better heat retention in the catalyst and minimum cross sectional thermal gradients due to conductive heat loss into the metal shell, and enable a better selection of metals for use in the shell because of metal isolation from very high temperatures, for example, low grade, low expansion ferritic stainless steel might be used.

While a presently preferred embodiment of the invention has been illustrated and described, it will be apparent that modifications thereof are within the spirit and scope of the invention. For example, in some assemblies it may be desirable to provide the flange means at one end only (preferably at the outlet end 37 to secure mechanical holding force) and eliminate the other flange means. Other means of holding the fiber portion 25 and/or 27 in bent position may be used, for example, a fold or indentation in shell 7 spaced from an end of the shell or the angle of the cone 3 or 5. Broadly, a structural assembly advantage is still achieved if the bent corners are entirely eliminated as the sleeve 7 fits inside of the inner ends of cones 3 and 5 and facilitates formation of the housing. Also, the subassembly 33 may be connected to inlet and outlet flow conduits of varying types and structures.

I claim:

1. The method of making a catalytic converter for use in exhaust systems of internal combustion engines comprising inserting a porous monolithic refractory catalyst element into a tubular metal shell with an annular nonmetallic fibrous resilient layer extending beyond one end of the element and located in an annular space between the outer periphery of said element and said shell, bending said extending end of the layer and a portion of the shell over an outer corner of the element, and attaching inlet and outlet conduit means to the shell and located respectively at opposite ends of the element to provide for passage of gas through the element.

2. In the method of making a catalytic converter for use in exhaust systems of internal combustion engines, the steps of inserting a frangible porous monolithic refractory catalyst element into a tubular metal shell with an annular resilient nonmetallic fibrous layer extending beyond an end of the element and located in an annular space between the outer periphery of said element and said shell and bending and maintaining said extending end of the layer over an outer corner of the element.

3. The method of claim 2 including the step of bending a portion of said shell over said bent extending layer portion to hold said layer over said corner.

4. The method of claim 2, further including the steps of impregnating the fibrous layer with an adhesive and rigidizing liquid and heating the layer to dry out the liquid and deposit solids contained therein on the fibers.

5. In the method of making a catalytic converter for use in exhaust systems of internal combustion engines, the steps of inserting a porous monolithic refractory catalyst element into a tubular metal shell with an annular nonmetallic resilient fibrous layer located in an annular space between the outer periphery of said element and said shell, injecting a colloidal adhesive and rigidizing solution into the fibrous layer, and heating the layer to evaporate the vehicle of said solution and deposit the colloidal material adjacent the outermost faces of the layer.

6. The method of making a catalytic converter for use in the exhaust systems of internal combustion engines which comprises assembling an annular layer of resilient fibers around the outer periphery of a porous monolithic refractory catalyst element so that an end portion of the layer extends axially a short distance beyond one end of the element, inserting the combined element and layer into a tubular metal shell by moving it axially with respect to the shell and positioning it axially in the shell so that an end portion of the shell extends axially a short distance beyond said end portion of the layer, bending said end portions of the layer and shell inwardly so that the layer portion extends radially across the adjacent corner of the element to act as a mechanical barrier against axial movement of the element, and attaching inlet and outlet headers to the shell and located respectively at opposite ends of the element to provide for passage of gas through the element.

7. A method as set forth in claim 6 including radially compressing the layer upon insertion of the layer and element into the shell.

8. A method as set forth in claim 6 wherein the end portions that are bent are located adjacent to the outlet header.

9. A method as set forth in claim 6 including the step of impregnating the layer with an adhesive and rigidizing liquid and heating the layer to dry out the liquid and deposit the solids adjacent the outermost faces of the layer.

10. In the method of making a catalytic converter for use in exhaust systems of internal combustion engines, the steps of inserting a porous monolithic refractory catalyst element into a tubular metal shell with an annular non-metallic resilient fibrous layer located in an annular space between the outer periphery of said element and said shell and having an end portion extending axially beyond an end of the element, injecting a colloidal adhesive and rigidizing solution into the fibrous layer, bending and maintaining said end portion of the layer radially across a corner of the element to provide means to axially support the element, and heating the layer to evaporate the vehicle of said solution and deposit the colloidal material adjacent the outermost faces of the layer.

11. The method of claim 10, further including the step of attaching flow conduits to opposite ends of the shell after said heating.

12. The method of making a catalytic converter for use in the exhaust systems of internal combustion engines which comprises assembling an annular layer of resilient fibers around the outer periphery of a porous monolithic refractory catalyst element so that opposite end portions of the layer extend axially a short distance beyond the adjacent ends of the element, inserting the combined element and layer into a tubular metal shell by moving it axially with respect to the shell and positioning it axially in the shell so that opposite end portions of the shell extend axially a short distance beyond the respective end portions of the layer, bending said end portions of the layer and shell inwardly so that the layer portions extend radially across the adjacent end corners of the element to act as mechanical barriers against axial movement of the element, and attaching inlet and outlet headers to the shell and located respectively at opposite ends of the element to provide for passage of gas through the element.

* * * * *